US011814952B2

(12) United States Patent
Machocki

(10) Patent No.: US 11,814,952 B2
(45) Date of Patent: Nov. 14, 2023

(54) SYSTEM AND METHOD TO MEASURE CHANGES IN THE MUD LEVEL AND GAS PROPERTIES WHEN DRILLING THROUGH A TOTAL LOSS ZONE WITH NO RETURNS TO SURFACE

(71) Applicant: SAUDI ARABIAN OIL COMPANY, Dhahran (SA)

(72) Inventor: Krzysztof Karol Machocki, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 52 days.

(21) Appl. No.: 17/538,644

(22) Filed: Nov. 30, 2021

(65) Prior Publication Data

US 2023/0167736 A1 Jun. 1, 2023

(51) Int. Cl.

| | |
|---|---|
| ***E21B 47/08*** | (2012.01) |
| ***E21B 21/08*** | (2006.01) |
| ***E21B 47/047*** | (2012.01) |
| ***E21B 47/06*** | (2012.01) |
| *E21B 47/003* | (2012.01) |
| *E21B 33/064* | (2006.01) |

(52) U.S. Cl.

CPC ..... *E21B 47/08* (2013.01); *E21B 21/08* (2013.01); *E21B 47/047* (2020.05); *E21B 47/06* (2013.01); *E21B 33/064* (2013.01); *E21B 47/003* (2020.05)

(58) Field of Classification Search

CPC ..... E21B 47/00; E21B 47/003; E21B 47/047; E21B 47/08; E21B 21/08

See application file for complete search history.

(56) References Cited

U.S. PATENT DOCUMENTS

| | | | | |
|---|---|---|---|---|
| 3,729,986 | A * | 5/1973 | Leonard | E21B 21/08 73/152.34 |
| 3,827,295 | A | 8/1974 | Rochon et al. | |
| 4,455,869 | A * | 6/1984 | Broussard | E21B 47/08 73/152.01 |
| 5,063,776 | A | 11/1991 | Zanker et al. | |
| 11,280,178 | B2 * | 3/2022 | Li | E21B 47/047 |
| 2015/0211362 | A1 | 7/2015 | Rogers | |

* cited by examiner

*Primary Examiner* — Jill E Culler

(74) *Attorney, Agent, or Firm* — Osha Bergman Watanabe & Burton LLP

(57) ABSTRACT

A method includes installing an influx device into a bell nipple. The influx device has an opening, a pumping port entrance, a pumping port exit, a measuring port entrance, and a measuring port exit. The pumping port exit is disposed in the annulus and the measuring port entrance is disposed adjacent the opening. The method further includes pumping a control gas, at a flow rate, from the pumping port entrance to the annulus using the pumping port exit, receiving the control gas at the measuring port exit using the measuring port entrance, detecting the control gas, using a gas measuring device connected to the measuring port exit, to determine a displacement time, and measuring the size of the void in the annulus using the flow rate and the displacement time.

10 Claims, 4 Drawing Sheets

SYSTEM AND METHOD TO MEASURE CHANGES IN THE MUD LEVEL AND GAS PROPERTIES WHEN DRILLING THROUGH A TOTAL LOSS ZONE WITH NO RETURNS TO SURFACE

BACKGROUND

In the oil and gas industry, hydrocarbons are located in porous formation far beneath the Earth's surface. Wells are drilled into the formations to produce the hydrocarbons. Wells are holes, often called a wellbore, drilled into the Earth's surface supported by one or more strings of casing. Mud is one of the primary tools used to drill a wellbore. Mud is used for many purposes including well control, operating/maintaining downhole tools, etc. When drilling a wellbore, a lost circulation zone may be encountered. A lost circulation zone may have large fractures or caverns to which the mud is lost. Sometimes, the drilling operation may experience "complete" or "partial" losses to the lost circulation zone. In extreme lost circulation scenarios, the muds stops returning to the surface and the mud level in the annulus of the well is unknown. It is important to measure the level of mud in the annulus to detect well control events and plan remedial operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for measuring a size of a void in an annulus. In one aspect, the method includes installing an influx device into a bell nipple, the influx device having an opening, a pumping port entrance, a pumping port exit, a measuring port entrance, and a measuring port exit. The pumping port exit is disposed in the annulus and the measuring port entrance is disposed adjacent the opening. The method further includes pumping a control gas, at a flow rate, from the pumping port entrance to the annulus using the pumping port exit, receiving the control gas at the measuring port exit using the measuring port entrance, detecting the control gas, using a gas measuring device connected to the measuring port exit, to determine a displacement time, and measuring the size of the void in the annulus using the flow rate and the displacement time. In one aspect, the system includes a bell nipple, an influx device, a pumping port entrance and exit, a measuring port entrance and exit, a gas measuring device, and an opening. The bell nipple has an inner diameter. The influx device incudes a tubular body having a top end, a bottom end, and an outer circumferential surface. The bottom end has an outer diameter smaller than the inner diameter of the bell nipple. The pumping port entrance and the measuring port exit are installed to the top end of the tubular body. The pumping port exit and the measuring port entrance are installed to the bottom end of the tubular body, and the pumping port exit is disposed within the annulus. The gas measuring device is connected to the measuring port exit. The opening is machined proximate the bottom end of the tubular body, and the measuring port entrance is disposed adjacent to the opening.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
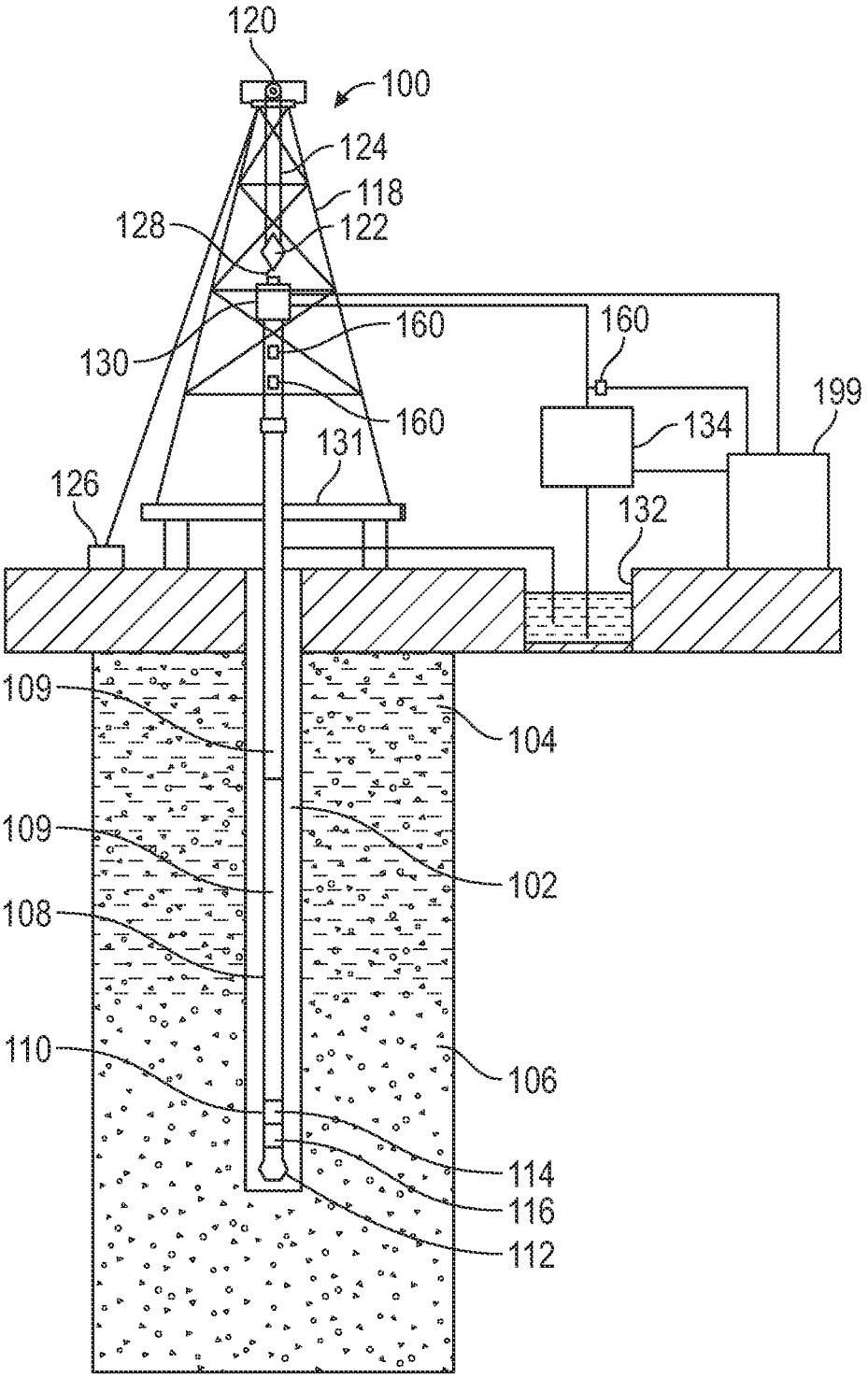
FIG. 1 shows an exemplary well site in accordance with one or more embodiments.

FIG. 1 illustrates an exemplary well site (100). In general, well sites may be configured in a myriad of ways. Therefore, the well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (104, 106). For the purpose of drilling a new section of wellbore (102), a drill string (108) is suspended within the wellbore (102).

The drill string (108) may include one or more drill pipes (109) connected to form conduit and a bottom hole assembly (BHA) (110) disposed at the distal end of the conduit. The BHA (110) may include a drill bit (112) to cut into the subsurface rock. The BHA (110) may include measurement tools, such as a measurement-while-drilling (MWD) tool (114) and logging-while-drilling (LWD) tool 116. Measurement tools (114, 116) may include sensors and hardware to measure downhole drilling parameters, and these measurements may be transmitted to the surface using any suitable telemetry system known in the art. The BHA (110) and the drill string (108) may include other drilling tools known in the art but not specifically shown.

The drill string (108) may be suspended in wellbore (102) by a derrick (118). A crown block (120) may be mounted at the top of the derrick (118), and a traveling block (122) may hang down from the crown block (120) by means of a cable or drilling line (124). One end of the cable (124) may be connected to a drawworks (126), which is a reeling device that can be used to adjust the length of the cable (124) so that the traveling block (122) may move up or down the derrick (118).

The traveling block (122) may include a hook (128) on which a top drive (130) is supported. The top drive (130) is coupled to the top of the drill string (108) and is operable to rotate the drill string (108). Alternatively, the drill string (108) may be rotated by means of a rotary table (not shown) on the drilling floor (131). Drilling fluid (commonly called mud) may be stored in a mud pit (132), and at least one pump (134) may pump the mud from the mud pit (132) into the drill string (108). The mud may flow into the drill string (108) through appropriate flow paths in the top drive (130) (or a rotary swivel, if a rotary table is used instead of a top drive to rotate the drill string (108)).

In one implementation, a system (199) may be disposed at or communicate with the well site (100). System (199) may control at least a portion of a drilling operation at the well site (100) by providing controls to various components of the drilling operation. In one or more embodiments, system (199) may receive data from one or more sensors (160) arranged to measure controllable parameters of the drilling operation. As a non-limiting example, sensors (160) may be arranged to measure WOB (weight on bit), RPM (drill string rotational speed), GPM (flow rate of the mud pumps), and ROP (rate of penetration of the drilling operation).

Sensors (160) may be positioned to measure parameter(s) related to the rotation of the drill string (108), parameter(s) related to travel of the traveling block (122), which may be used to determine ROP of the drilling operation, and parameter(s) related to flow rate of the pump (134). For illustration purposes, sensors (160) are shown on drill string (108) and proximate mud pump (134). The illustrated locations of sensors (160) are not intended to be limiting, and sensors (160) could be disposed wherever drilling parameters need to be measured. Moreover, there may be many more sensors (160) than shown in FIG. 1 to measure various other parameters of the drilling operation. Each sensor (160) may be configured to measure a desired physical stimulus.

During a drilling operation at the well site (100), the drill string (08) is rotated relative to the wellbore (102), and weight is applied to the drill bit (112) to enable the drill bit (112) to break rock as the drill string (108) is rotated. In some cases, the drill bit (112) may be rotated independently with a drilling motor. In further embodiments, the drill bit (112) may be rotated using a combination of the drilling motor and the top drive (130) (or a rotary swivel if a rotary table is used instead of a top drive to rotate the drill string (108)).

While cutting rock with the drill bit (112), mud is pumped into the drill string (108). The mud flows down the drill string (108) and exits into the bottom of the wellbore (102) through nozzles in the drill bit (112). The mud in the wellbore (102) then flows back up to the surface in an annular space between the drill string (108) and the wellbore (102) with entrained cuttings. The mud with the cuttings is returned to the pit (132) to be circulated back again into the drill string (108). Typically, the cuttings are removed from the mud, and the mud is reconditioned as necessary, before pumping the mud again into the drill string (108). In one or more embodiments, the drilling operation may be controlled by the system (199).

Figure 2C:
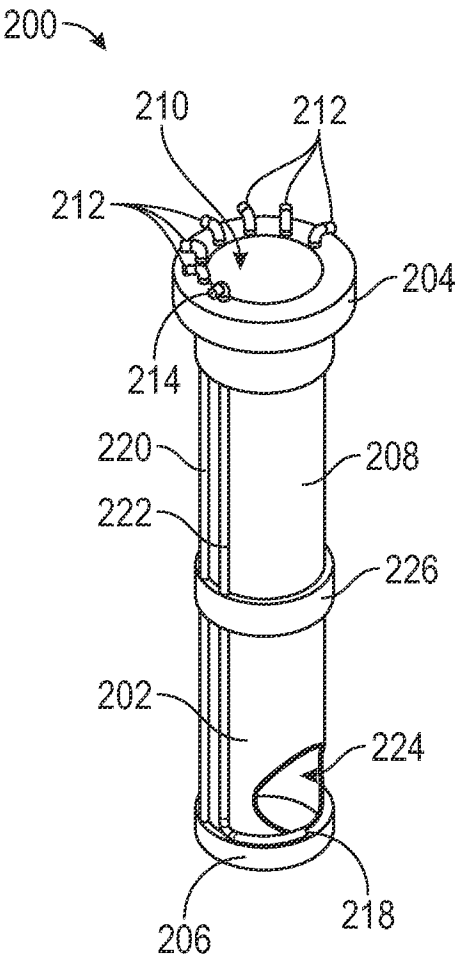
FIGS. 2*a*-2*c* show an influx device in accordance with one or more embodiments.
Figure 2B:
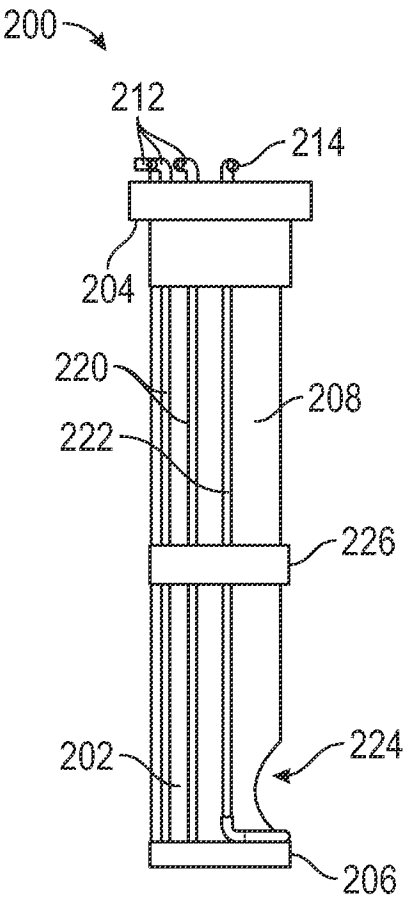
Figure 2A:
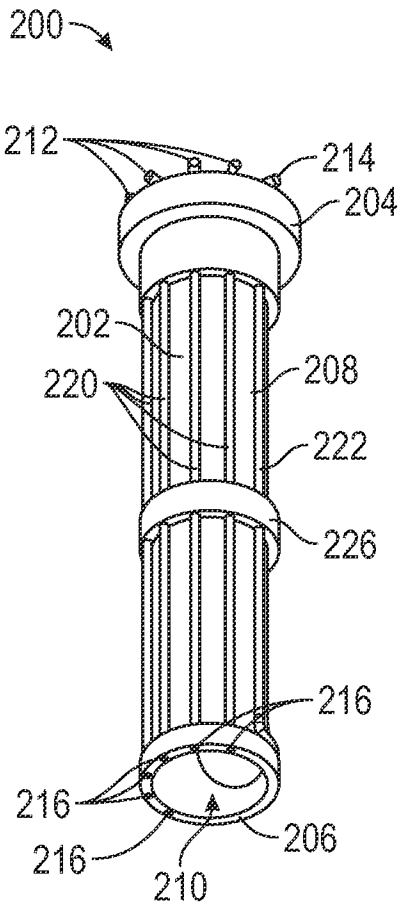

FIGS. 2*a*-2*c* show an influx device (200) in accordance with one or more embodiments. Specifically, FIG. 2*a* shows an angled side and bottom view of the influx device (200), FIG. 2*b* shows a direct side view of the influx device (200), and FIG. 2*c* shows an angled side and top view of the influx device (200). The influx device (200) has a tubular body (202). The tubular body (202) may be made out of a durable material, such as steel. The tubular body (202) has a top end (204), a bottom end (206), and an outer circumferential surface (208) located between the top end (204) and the bottom end (206). A conduit (210) extends through the tubular body (202) from the top end (204) to the bottom end (206). The top end (204) may have an outer diameter larger than the outer diameter of the bottom end (206). The top end (204) may be a flange connection in accordance with one or more embodiments.

At least one pumping port entrance (212) is installed to the top end (204) of the influx device (200). The pumping port entrance (212) may be the beginning or end of a small pipe. The pumping port entrance (212) may extend into the body of the top end (204) as shown in FIGS. 2*a*-2*c*. In one or more embodiments, there are six pumping port entrances (212) located on the top end (204) of the influx device (200). A measuring port exit (214) is also installed to the top end (204) of the influx device (200). The measuring port exit (214) may also be the beginning or end of a small pipe. The measuring port exit (214) may also extend into the body of the top end (204) as shown in FIGS. 2*a*-2*c*.

At least one pumping port exit (2.16) is installed to the bottom end (206) of the influx device (200). The pumping port exit (216) may be beginning or end of a small pipe. The pumping port exit (216) may extend into the body of the bottom end (206) as shown in FIGS. 2*a*-2*c*. In one or more embodiments, there may be the same number of pumping port exits (216) as there are pumping port entrances (212). A measuring port entrance (218) is also installed to the bottom end (206) of the influx device (200). The measuring port entrance (218) may also be the beginning or end of a small pipe.

A pumping extension tube (220) may extend along the outer circumferential surface (208) of the tubular body (202) from one pumping port entrance (212) to one pumping port exit (216). In accordance with one or more embodiments, the pumping port entrance (212) and the pumping port exit (216) are intrinsically part of the pumping extension tube (220) rather than separate components. The pumping extension tube (220) may be hydraulically connected to the pumping port entrance (212) and the pumping port exit (216). In one or more embodiments, there may be six pumping port entrances (212), six pumping port exits (216), and six pumping extension tubes (220). Each pumping port entrance (212) may correspond with one pumping port exit (216) and one pumping extension tube (220).

A measuring extension tube (222) may extend along the outer circumferential surface (208) of the tubular body (202) from one measuring port entrance (218) to one measuring port exit (214). In accordance with one or more embodiments, the measuring port entrance (218) and the measuring port exit (214) are intrinsically part of the measuring extension tube (222) rather than separate components. The measuring extension tube (222) may be hydraulically connected to the measuring port entrance (218) and the measuring port exit (214).

An opening (224) may be machined into the outer circumferential surface (208) of the tubular body (202) proximate the bottom end (206) of the tubular body (202). The measuring port entrance (218) may be disposed adjacent to the opening (224). In one or more embodiments, the measuring port entrance (218) may extend along the bottom end (206) to the opening (224) of the tubular body (202), such that a fluid exiting the conduit (210) of the tubular body (202), through the opening (224), may also enter the measuring port entrance (218).

A seal element (226) may be disposed around the outer circumferential surface (208) of the influx device (200), The pumping extension tube (220) and the measuring extension tube (222) may pass through the seal element (226) as shown in FIGS. 2*a*-2*c*, or the pumping extension tube (2.20) and the measuring extension tube (222) may be located underneath the seal element (226) between the seal element (226) and the outer circumferential surface (208). The seal element (226) may be a ring made of a durable material such as steel, or the seal element (226) may be a ring made out of rubber.

Figure 3B:
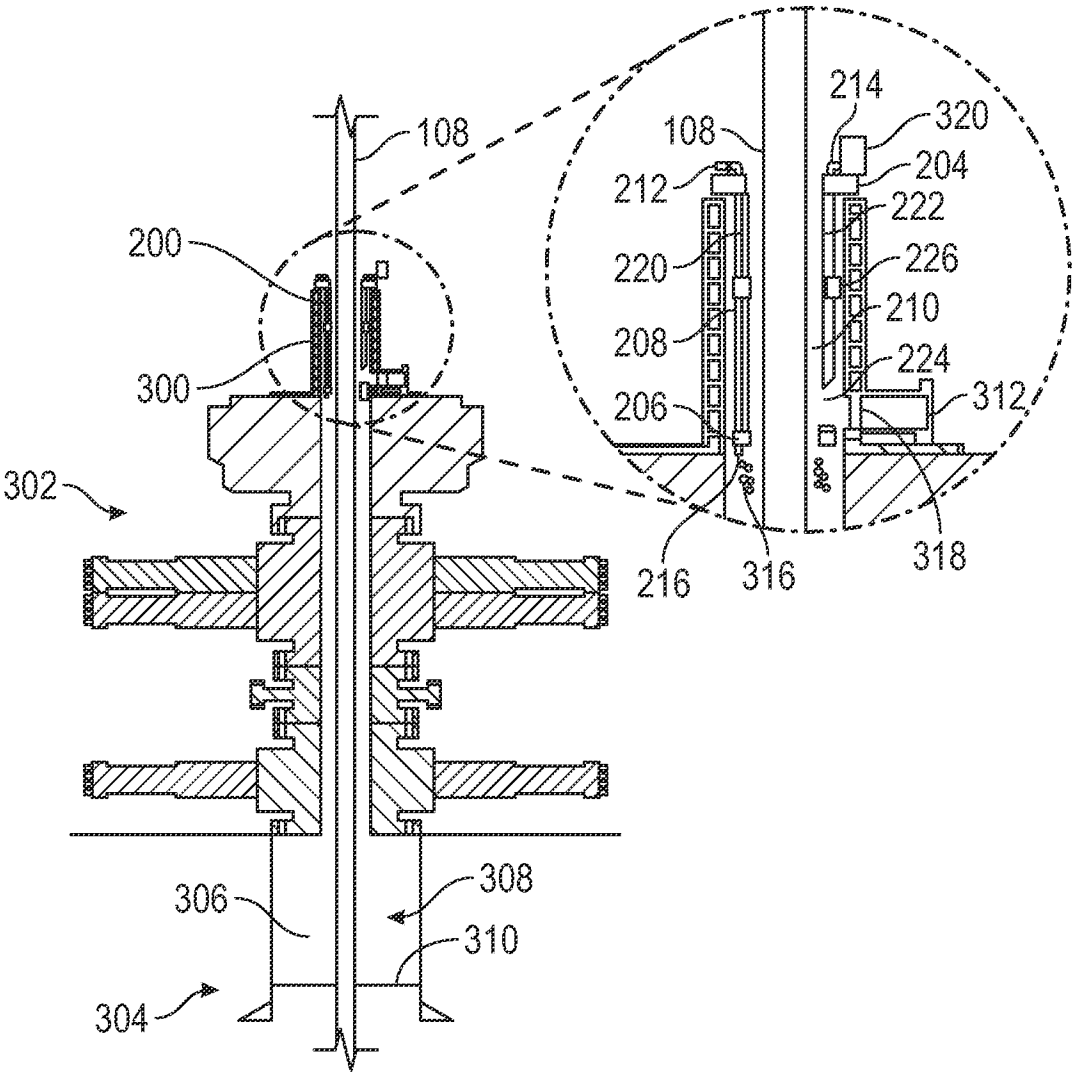
FIGS. 3*a* and 3*b* show a system incorporating the influx device in accordance with one or more embodiments.
Figure 3A:
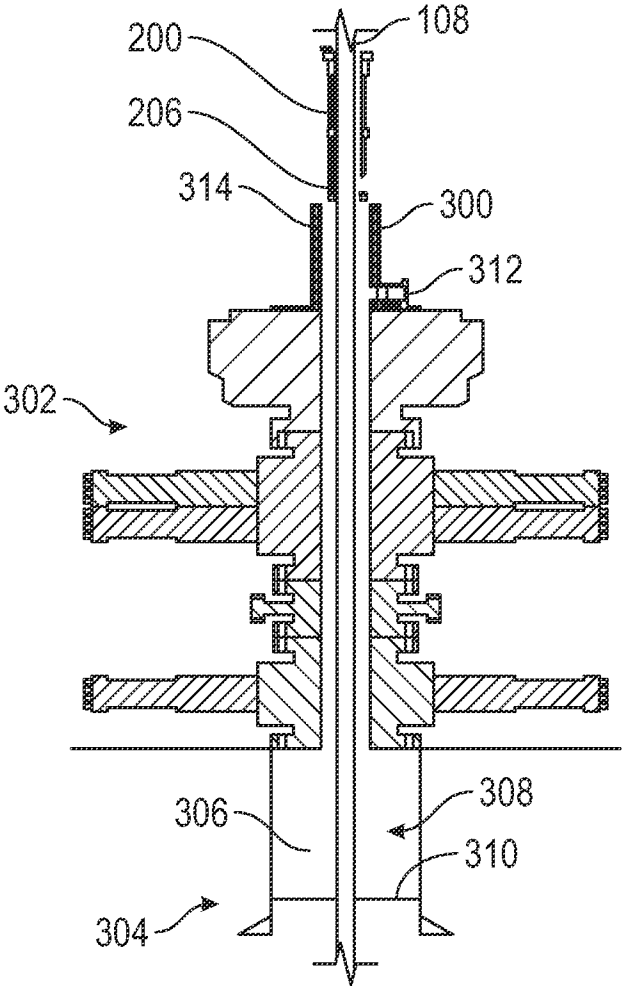

FIGS. 3*a* and 3*b* show a system incorporating the influx device (200) in accordance with one or more embodiments. Components shown in FIGS. 3*a* and 3*b* that are similar to or the same as components shown in FIGS. 1-2*c* have not been redescribed for purposes of readability and have the same function and description as outlined above. Specifically, FIG. 3*a* shows the influx device (200) being installed into a bell nipple (300) connected to a blowout preventer (BOP) (302), and FIG. 3*b* shows the influx device (200) installed in the bell nipple (300) while undergoing an operation.

The BOP (302) is capping a well (304) and may be used in conjunction with one or more components of the drilling system outlined in FIG. 1. The BOP (302) may be any type of BOP (302) known in the art and rated to any pressure. The well (304) may be undergoing a loss of fluid returns. The loss of fluid returns may create a void (306) in the annulus (308). The size of the void (306) is defined by a fluid level (310). A drill string (108) is running through the BOP (302) into the well (304). The bell nipple (300) is connected to the BOP (302) using any means in the art such as a flange connection. The bell nipple (300) may be an enlarged pipe at the top of the BOP (302) that may serve as a funnel to guide drilling tools into the well (304). The bell nipple (300) is fit with a fluid return flange (312) that permits drilling fluid to flow back to the surface, the surface being any location on or above the surface of the Earth.

FIG. 3*a* shows the influx device (200) being lowered into the bell nipple (300) using the drill string (108). The influx device (200) is disposed around the drill string (108), that is, the drill string (108) extends through the conduit (210) of the influx device (200). The influx device (200) may be disposed around the drill string (108) by slipping the influx device (200) over the drill string (108) while the drill string (108) is being held up by slips on the rig floor, other embodiments, the influx device (200) may be designed having two halves that can be connected to one another. The influx device (2.00) may be split into two halves along the conduit (210). The two halves of the influx device (200) may be lined up to one another, with the drill string (108) in the conduit (210), and the two halves may be connected to one another using any means in the art such as bolts and nuts or welding.

The bottom end (206) of the influx device (200) may have an outer diameter smaller than the inner diameter of the first end (314) of the bell nipple (300). The bottom end (206) of the influx device (200) may enter the bell nipple (300). FIG. 3*b* shows the influx device (200) fully installed in the bell nipple (300). The majority of the influx device (200) including the bottom end. (206), the outer circumferential surface (208), and the seal element (226) are located within the bell nipple (300). The seal element (226) may be sized to fit flush within the bell nipple (300) such that fluids coming from the annulus (308) of the well (304) cannot escape to the external environment at the surface using the space located between the inside of the bell nipple (300) and the outside of the influx device (200).

The top end (204) of the influx device (200) may sit on top of the first end (314) of the bell nipple (300). The first end (314) of the bell nipple (300) may include a flange connection and may be connected to the influx device (200) through a corresponding flange connection on the top end (204) of the influx device (200). The opening (224) of the influx device (200) is aligned with the fluid return flange (312) such that fluid coming from the well (304) may move from the annulus (308) to the conduit (210) of the influx device (200) and into the fluid return flange (312). The pumping port exit (216) is disposed below the influx device (200) within the annulus (308), and the measuring port entrance (218) is disposed adjacent the opening (224) and the fluid return flange (312).

The pumping port entrance (212) may be connected to gas lines and/or a gas tank (not pictured) containing a control gas (316). The control gas (316) may be any known gas with controlled properties. Further, the control gas (316) may be denser than the gasses expected to be entering the annulus (308) from the formation being drilled. In one or more embodiments, the control gas (316) may be carbon dioxide. In other embodiments, multiple control gases (316) can be used, and each control gas (316) would have distinguishing properties.

In this scenario, the lighter control gas (316) would be pumped into the annulus (308) followed by the heavier control gas (316). Different properties of the control gases (316) may be used such as a different color, chemical content, different temperature, etc. In such embodiments, different properties of the control gases (316) will help to measure the volume of the annulus (308). The control gas (316) is pumped into the pumping port entrance (212), through the pumping extension tube (220), and out of the pumping port exit (216) into the annulus (308) as shown in FIG. 3*b*. The control gas (316) may be pumped into the void (306) of the annulus (308) at a measured volume and flow rate.

The control gas (316) may be pumped into the void (306) until the void (306) has been completely displaced with control gas (316). The time it takes for the control gas (316) to completely displace the void (306) is called the displacement time. At this point, the control gas (316) enters the conduit (210) of the influx device (200) to enter the fluid return flange (312). The measuring port entrance (218) being adjacent the opening (224) and the fluid return flange (312) means that the control gas (316) is able to enter the measuring port entrance (218), travel through the measuring extension tube (222), and out of the measuring port exit (214). The measuring port exit (214) may be connected to a gas measuring device (320).

The gas measuring device (320) may be any gas measuring device (320) known in the art such as a velocity-type gas meter, a thermal-type gas meter, etc. The gas measuring device (320) may be able to detect both the volume and the type of gas exiting the measuring port exit (214). Further, the gas measuring device (320) may be equipped with an ability to draw the control gas (316) through the measuring extension tube (222) from the measuring port entrance (218). In further embodiments, an external gas measuring device, or gas probe, situated near the bell nipple (300) may be used to alert to a rapid eruption of control gas (316) or formation gas from the BOP (302).

In accordance with one or more embodiments, a sealed guard (318) may be mounted in the opening (224) or in the fluid return flange (312) to block a flow of fluid. The sealed guard (318) may be hydraulically, electronically, or mechanically actuated to jut out of the tubular body (202) or out of the fluid return flange (312) to block the control gas (316) from flowing from the conduit (210) and out of the fluid return flange (312). This would force the control gas (316) to enter the measuring port entrance (218). The sealed guard (318) may operate similar to a gate valve. The volume of the void (306) in the annulus (308) is able to be measured by using the influx device (200) and the time it takes for the control gas (316) to fully displace the void (306) and return to the gas measuring device (320). This method is further outlined in FIG. 4 described below.

Figure 4:
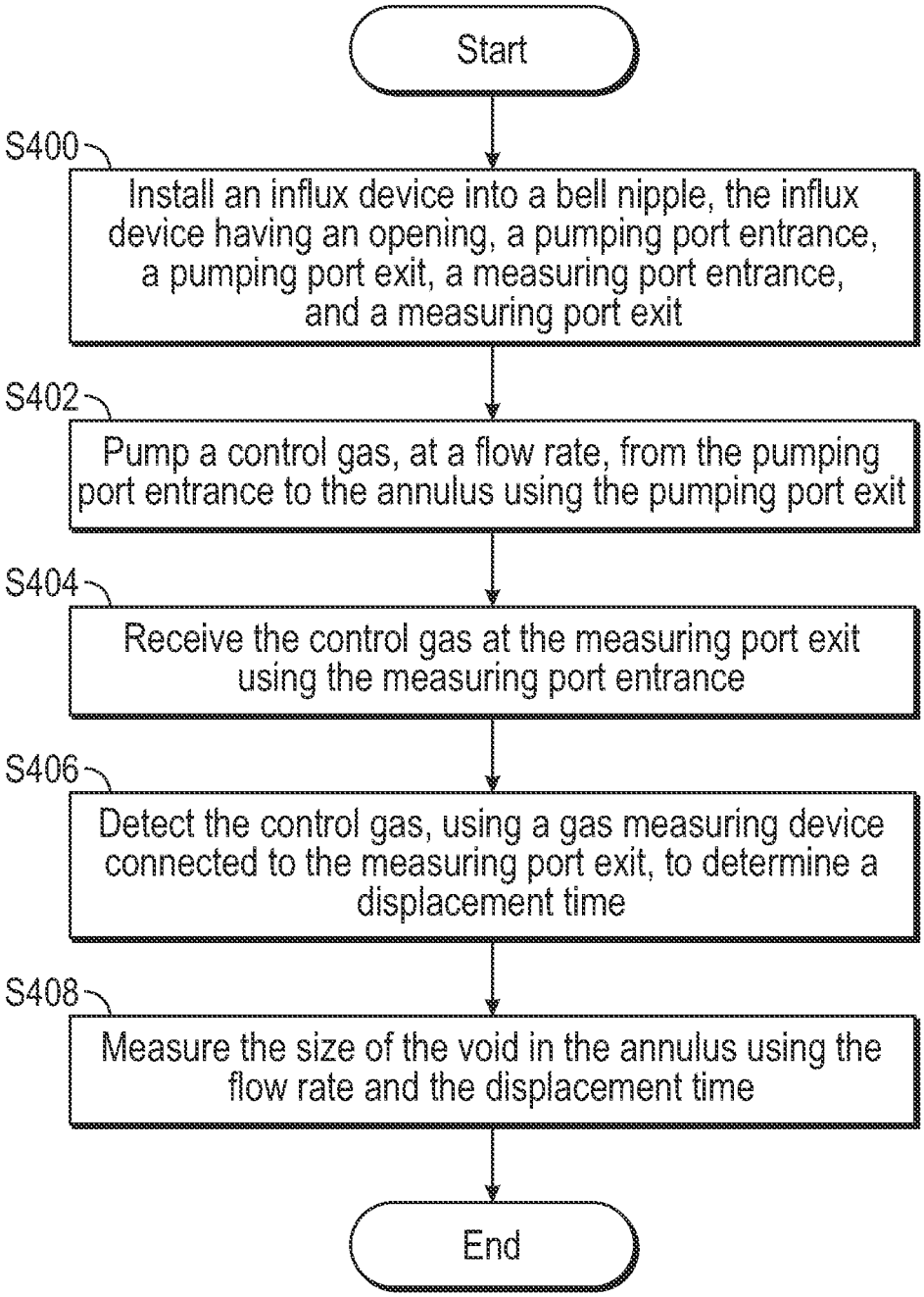
FIG. 4 shows a flowchart in accordance with one or more embodiments.

FIG. 4 shows a flowchart in accordance with one or more embodiments. The flowchart outlines a method for measuring a size of a void (306) in an annulus (308). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, an influx device (200) is installed into a bell nipple (300), the influx device (200) having an opening (224), a pumping port entrance (212), a pumping port exit (216), a measuring port entrance (218), and a measuring port exit (214) (S400). The bell nipple (300) may be installed on a BOP (302). The influx device (200) is installed in the bell nipple (300) by inserting, a bottom end (206) of the influx device (200) into a first end (314) of the bell nipple (300). A top end (204) of the influx device (200) is connected to the first end (314) of the bell nipple (300). The top end (204) may be connected to the first end (314) using a flange connection.

As the influx device (200) is being installed in the bell nipple (300), the Opening (224) of the influx device (200) is aligned with a fluid return flange (312) connected to the bell nipple (300). In accordance with one or more embodiments, the influx device (200) is installed in the bell nipple (300) using a drill string (108). The influx device (200) is disposed around the drill string (108) and the drill string (108) lowers the influx device (200) into the bell nipple (300).

A control gas (316) is pumped, at a flow rate, from the pumping port entrance (212) to the annulus (308) using the pumping port exit (216) (S402). The control gas (316) is transported from the pumping port entrance (212) to the pumping port exit (216) using a pumping extension tube (220) fixed to an outer circumferential surface (208) of the influx device (200). The control gas (316) may be transported to the pumping port entrance (212) using a system of gas tanks and gas lines connected to the pumping port entrance (212). The control gas (316) enters the annulus (308) and may displace the void (306) in the annulus (308).

The control gas (316) is received at the measuring port exit (214) using the measuring port entrance (218) (S404) once the void (306) has been displaced with the control gas (316). In one or more embodiments, a sealed guard (318) may be used to block the flow path through the fluid return flange (312) and prevent the control gas (316) from exiting through the opening (224). This may force the control gas (316) to enter the measuring port entrance. The control gas (316) is transported from the measuring port entrance (218) to the measuring port exit (214) using a measuring extension tube (222) fixed to an outer circumferential surface (208) of the influx device (200). The control gas (316) is detected, using a gas measuring device (320) connected to the measuring port exit (214), to determine a displacement time (S406). The size of the void (306) in the annulus (308) is measured using the flow rate and the displacement time (S408).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C, § 112, paragraph 6 for any limitations of any of the claims herein, except for those in which the claim expressly uses the words 'means for' together with an associated function,

What is claimed is:

1. A system for an annulus, the system comprising:

a bell nipple having an inner diameter;

an influx device comprising a tubular body having a top end, a bottom end, and an outer circumferential surface, wherein the bottom end has an outer diameter smaller than the inner diameter of the bell nipple;

a pumping port entrance and a measuring port exit installed to the top end of the tubular body;

a pumping port exit and a measuring port entrance installed to the bottom end of the tubular body, wherein the pumping port exit is disposed within the annulus;

a gas measuring device connected to the measuring port exit; and an opening machined proximate the bottom end of the tubular body, wherein the measuring port entrance is disposed adjacent to the opening.

2. The system of claim 1, further comprising a pumping extension tube extending along the outer circumferential surface of the tubular body from the pumping port entrance to the pumping port exit.

3. The system of claim 1 further comprising a measuring extension tube extending along the outer circumferential surface of the tubular body from the measuring port entrance to the measuring port exit.

4. The system of claim 1, wherein the bell nipple further comprises a fluid return flange.

5. The system of claim 4, wherein the opening of the tubular body is aligned with the fluid return flange.

6. The system of claim 1, wherein the bell nipple is connected to a blowout preventer.

7. The system of claim 1, further comprising a seal element disposed around the outer circumferential surface of the influx device.

8. The system of claim 7, wherein the seal element is sized to fit flush within the bell nipple.

9. The system of claim 1, wherein the top end of the influx device comprises a flange connection.

10. The system of claim 9, wherein the flange connection of the influx device mates with a corresponding flange connection on the bell nipple.

* * * * *